United States Patent [19]

Danner

[11] 4,329,390

[45] May 11, 1982

[54] CATIONIC SURFACTANT-CONTAINING AQUEOUS WAX DISPERSIONS, AND THEIR USE AS TEXTILE FINISHING AGENTS

[75] Inventor: Bernard Danner, Riedisheim, France

[73] Assignee: Sandoz Ltd., Basel, Switzerland

[21] Appl. No.: 120,464

[22] Filed: Feb. 11, 1980

[30] Foreign Application Priority Data

Feb. 13, 1979 [CH] Switzerland ..... 1401/79

[51] Int. Cl.[3] ..... B32B 7/00; D03D 3/00; B05D 3/02

[52] U.S. Cl. ..... 428/264; 106/271; 252/8.8; 427/389.9; 428/265; 428/267; 428/280; 428/290; 428/904

[58] Field of Search ..... 252/8.6, 8.8; 106/270, 106/271; 427/389.9; 260/28 R, 28.5 R; 428/264, 265, 267, 280, 290, 904

[56] References Cited

U.S. PATENT DOCUMENTS 3,486,911 12/1969 Goldstein ..... 106/271 X
3,539,367 11/1970 Yaroshevich et al. ..... 106/271

FOREIGN PATENT DOCUMENTS 1298562 6/1962 France .
1299994 6/1962 France .
1055344 1/1967 United Kingdom .
1532869 11/1978 United Kingdom .

OTHER PUBLICATIONS

*Emulsifiable AC Polyethylene for Textiles,* Semet-Solvay Petrochemical Division, Allied Chemical, 1958.

*Primary Examiner*—Michael R. Lusignan
*Attorney, Agent, or Firm*—Gerald D. Sharkin; Robert S. Honor; Joseph J. Borovian

[57] ABSTRACT

Aqueous dispersions of an oxidized microcrystalline wax, optionally together with one or more non-oxidized paraffins, in which a cationic surfactant is used as dispersing agent may be applied to textile substrates by impregnation or exhaust processes. The treated textile substrates, particularly knitted goods, have improved sewability and are less liable to damage by high-speed sewing machines.

10 Claims, No Drawings

CATIONIC SURFACTANT-CONTAINING AQUEOUS WAX DISPERSIONS, AND THEIR USE AS TEXTILE FINISHING AGENTS

This invention relates to textile finishing agents for improving the sewing properties of textiles.

The invention provides an aqueous dispersion of an oxidized microcrystalline wax, containing a cationic surfactant as dispersing agent.

Microcrystalline waxes are obtainable from crude petroleum fractions, particularly from the residues of petroleum distillation and from the waxes which are deposited upon storage of crude oil (tank bottom waxes and pipe waxes). They consist of paraffinic hydrocarbons containing a relatively high proportion of branched-chain alkanes, and are characterised by having a finer, less apparent crystal structure than paraffin wax.

Microcrystalline waxes, particularly those derived from tank bottoms, may be oxidized for example by ozone or by atmospheric oxygen in the presence of a catalyst. The oxidized microcrystalline waxes may be characterised by acid number, esterification number, melting point and hardness (as measured by the penetration value according to ASTM-D-1321). The production, properties and oxidation of microcrystalline waxes are described for example in Warth "The Chemistry and Technology of Waxes" 2nd Edition, Reinhold, New York; Kirk Othmer "Encyclopedia of Chemical Technology" 2nd Edition Vol. 15 pages 92–102 and Bennet "Industrial Waxes", Chemical Publishing Co., New York.

Preferred oxidized microcrystalline waxes for use in the present invention are those having, independently, an acid number of 5 to 65, preferably 8 to 40, more preferably 10 to 30; an esterification number of 15 to 90, preferably 20 to 80, more preferably 20 to 60; a melting point of at least 80° C., preferably 80° to 105° C., more preferably 90°–98° C., and a penetration value according to ASTM-D-1321 of 1 to 16, preferably 1 to 8. The molecular weight may be between 300 and 3000, preferably between 500 and 700.

As well as the oxidized microcrystalline wax, the dispersion according to the invention may contain, as optional components, one or more non-oxidized paraffins. One preferred form of non-oxidized paraffin is a non-microcrystalline paraffin wax which melts at at least 30° C., preferably from 30° to 105° C., more preferably from 30° to 65° C. Such waxes, unlike microcrystalline waxes, crystallize in the form of large plates or needles, and consist mainly of straight-chain alkanes. A further form of non-oxidized paraffin which may be present is a paraffin which melts at a temperature below 30° C. and which boils at a temperature higher than the melting point of the oxidized microcrystalline wax or of the mixture of oxidized microcrystalline wax and unoxidized paraffin wax, if such is present. Preferably the boiling point of this paraffin component is higher than 130° C., more preferably higher than 150° C. This low-melting paraffin component is preferably an isoparaffin, i.e. a paraffin containing branched chain alkanes.

Any unoxidized paraffin which may be present as an optional component is also dispersed in the aqueous medium.

The term "dispersion" herein includes both suspensions of solid particles (i.e. below the melting point of the wax component) and emulsions of liquid droplets in water (i.e. above the melting point of the wax component).

The cationic surfactant used as dispersing agent (emulsifier) according to the present invention may in principle be any cationic surfactant suitable for example for the preparation of oil-in-water emulsions. Preferred cationic surfactants are those whose molecule contains at least one lipophilic aliphatic residue having at least 7 carbon atoms, and at least one cationic nitrogen atom. By a cationic nitrogen atom is meant a nitrogen atom which either carries a positive charge (e.g. a protonated or quaternary amino group) or can be readily protonated in aqueous solution (e.g. an amino group which is not bound to one or more acyl groups so as to form an amide or imide). Such surfactants may contain additional groups, for example alkanol groups, polyglycol ether chains, amide and/or ester groups or polyol residues.

The aliphatic residue may be in the form of an alkyl, alkenyl or acyl group, and preferably contains from 8 to 22, more preferably 12 to 22, particularly 16 to 18 carbon atoms. Any other alkyl groups in the molecule may contain up to 22 carbon atoms, but are preferably lower alkyl groups containing 1 to 4 carbon atoms, and are more preferably methyl or ethyl groups. Alkylene bridging groups preferably contain from 2 to 6 carbon atoms, and are preferably either linear polymethylene groups or are 1,2-propylene. When such a group is between two nitrogen atoms it is preferably an ethylene, propylene or hexamethylene group, particularly ethylene and 1,3-propylene; when it is between two oxygen atoms or one oxygen and one nitrogen atom it preferably has from 2 to 4 carbon atoms and is particularly ethylene or 1,2-propylene, especially ethylene. Preferably the cationic surfactant contains no aromatic group. The term "acyl group" is used herein in the limited sense of an alkyl- or alkenylcarbonyl group.

The cationic surfactants must have the lipophilic aliphatic residue in the cationic part of the molecule, and are thereby distinguished from amine soap surfactants which are salts having a nitrogen-containing cation and a long-chain aliphatic carboxylate anion.

In particular, the following types of cationic surfactant are preferred dispersing agents in the present invention:

(a) fatty amines of formula I

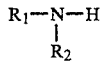

I in which $R_1$ is $C_{8-22}$alkyl or $C_{8-22}$alkenyl and $R_2$ is hydrogen, $C_{1-22}$alkyl or $C_{3-22}$alkenyl, together with their ethylene oxide and/or propylene oxide addition products (b) fatty amines of formula II

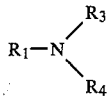

II in which $R_1$ is as defined above and $R_3$ and $R_4$ are independently $C_{1-22}$alkyl or $C_{3-22}$alkenyl (c) polyamines of formula III $$R_1\text{-}(NH\text{—}A)_m NH_2 \qquad \text{III}$$

in which $R_1$ is as defined above,

A is —$CH_2$—$CH_2$— or —$CH_2$—$CH_2$—$CH_2$— and m is an integer from 1 to 4, whereby when m > 1, the groups A may be the same or different, together with their ethylene oxide and/or propylene oxide addition products and the products of alkylating some or all of the nitrogen atoms and/or acylating less than all of the nitrogen atoms with saturated or unsaturated acyl groups containing up to 22 carbon atoms.

(d) acylation products of polyamines of formula IV $$H_2N\text{-}(A\text{—}NH)_n H \qquad \text{IV}$$

where A is as defined above and n is an integer from 1 to 5, whereby when n > 1 the groups A may be the same or different, with up to n saturated or unsaturated acyl groups containing up to 22 carbon atoms, at least one of which is of formula $R_5$—CO— where $R_5$ is $C_{7-22}$alkyl or $C_{7-21}$alkenyl; together with their alkylation, oxyethylation and/or oxypropylation products (e) compounds of formula V $$R_5\text{—}CO\text{—}NH(CH_2)_6NH_2 \qquad \text{V}$$

in which $R_5$ is as defined above together with their alkylation, oxyethylation and/or oxypropylation products (f) O-acylation products of ethanolamines of formula VI

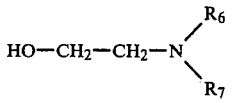

VI in which $R_6$ and $R_7$ are independently $C_{1-4}$alkyl or —$CH_2CH_2OH$, with up to 3 saturated or unsaturated acyl groups containing up to 22 carbon atoms, at least one of which is of formula $R_5$—CO—, where $R_5$ is as defined above; whereby, when the acylation product contains one or two —OH groups, these may be alkylated, oxyethylated and/or oxypropylated (g) monoacylation products of diethanolamine with the acyl group $R_5CO$—, where $R_5$ is as defined above, that is, mixtures of esters and amides of formulae VII and VIII

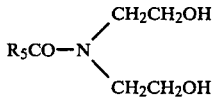

VII

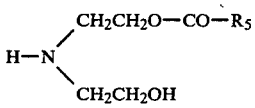

VIII and acylation products of N-aminoethyl-N-ethanolamine with from 1 to 2 $R_5CO$— groups, that is, mixtures whose main components are of formulae IX–XI $$R_5CO\text{—}NHCH_2CH_2NHCH_2CH_2OH \qquad \text{IX}$$

-continued

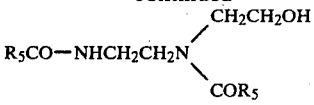

X $$R_5CO\text{—}NHCH_2CH_2NH\text{—}CH_2CH_2O\text{—}COR_5, \qquad \text{XI}$$

whereby in monoacylation the main product is IX, in diacylation the product is chiefly a mixture of X and XI, and in intermediate degrees of acylation the product will contain all three compounds; together with the alkylation, oxyethylation and/or oxypropylation products of the compounds VII–XI. (It will be noted that the individual compounds VII and X are not cationic surfactants as herein defined, but these compounds will always be in association with compounds such as VIII, IX and XI, which are cationic surfactants.)

(h) Imidazolines of formula XII

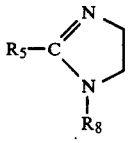

XII in which $R_5$ is as previously defined and $R_8$ is —$CH_2CH_2OH$, —$CH_2CH_2NH_2$ or —$CH_2CH_2CH_2NH_2$, together with their acylation (with saturated or unsaturated acyl groups containing up to 22 carbon atoms), alkylation, oxyethylation and/or oxypropylation products (i) reaction products of compounds of formula XIII $$R_1\text{-}(O\text{—}A')_p OCH_2\text{—}CHOH\text{—}CH_2Cl \qquad \text{XIII}$$

in which $R_1$ is as defined above,

A' is —$CH_2CH_2$— or —$CH_2CH(CH_3)$— and p is from 0 to 20, with amines of formulae I, III or IV above or XIV

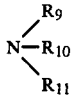

XIV in which $R_9$, $R_{10}$ and $R_{11}$ are independently hydrogen or —$CH_2CH_2OH$ (j) compounds of formula XV

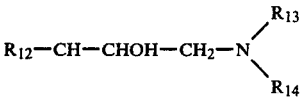

XV in which $R_{12}$ is a group of formula $R_5COO$—, $R_5CONHCH_2CH_2O$—, $R_1O$— or $R_1NH$— in which $R_1$ and $R_5$ are as defined above, $R_{13}$ is hydrogen, methyl or ethyl, and $R_{14}$ is $C_{8-22}$alkyl or alkenyl, or a group of formula —$CH_2CH_2CH_2NHR_1$ or —$CH_2CH_2OH$.

In the above products (a)–(j), alkyl groups as $R_1$ or $R_{14}$ are preferably $C_{12-22}$alkyl, particularly $C_{16-18}$alkyl.

Alkenyl groups as $R_1$ and $R_{14}$ preferably contain only one double bond and are preferably $C_{16-22}$alkenyl, particularly oleyl. Acyl groups of 8 to 22 carbon atoms, including $R_5CO$—, if saturated preferably contain from 12 to 22 atoms, particularly 16 to 18 carbon atoms, and if unsaturated preferably contain only one double bond, the acyl residue of oleic acid being particularly preferred.

The products (a)–(j) may be used as single compounds or as mixtures. Mixtures of compounds may arise in various ways; for example by acylation in different positions as in (g) above, by oxyalkylation reactions in which there will be a statistical distribution of alkylene oxide chain lengths about the average value, or by the incorporation of lipophilic aliphatic residues as alkyl, alkenyl or acyl groups derived from technical mixtures or fatty acids. Preferably such residues are derived from mixtures of fatty acids containing one or more of lauric, myristic, palmitic, stearic, behenic, arachinic, palmitoleic and oleic acids, mixtures averaging 16 to 18 carbon atoms per molecule being preferred. Mixtures of surfactants may also be mixtures of different compounds within the same groups (a)–(j), for example compounds of formula III having different values of m, or mixtures of products of different groups.

Lower alkyl groups in products (a)–(j) are preferably those having 1–4 carbon atoms, more preferably methyl and ethyl, particularly methyl. Lower alkenyl groups as $R_2$, $R_3$ and $R_4$ are particularly allyl, and acyl groups containing lower alkenyl groups are preferably acrylyl and methacrylyl. In general, however, of the lower alkyl and alkenyl groups, the alkyl groups are preferred.

Oxyethylation and oxypropylation products as described above contain preferably 1–20 alkylene oxide units in each alkylene oxide chain, but preferably contain no more than 100 alkylene oxide units per molecule. Preferably the molecule contains 1–15 alkylene oxide units per cationic nitrogen atom. Preferably at least 50 mole %, more preferably all of the alkylene oxide units present are oxyethylene units. By alkylation is meant not only introduction of alkyl groups, preferably $C_{1-14}$alkyl, more preferably methyl and ethyl, particularly methyl, but also the introduction of benzyl groups.

The above surfactants may be used in free base, protonated or quaternary salt form. If in protonated form, which is preferred, they are preferably protonated by an acid which does not have a higher melting point than the oxidized microcrystalline wax, e.g. formic, acetic, propionic or phosphoric acid. If in quaternary salt form, the quaternising agent is preferably one which donates a $C_{1-4}$alkyl group, preferably ethyl or, particularly, methyl, or a benzyl group. Suitable quaternising agents for example are diethyl sulphate, dimethyl sulphate, methyl chloride or bromide and benzyl chloride or bromide, dimethyl sulphate being preferred.

Optionally, non-ionic surfactants may be used in addition to the cationic surfactants. Suitable non-ionic surfactants are such as are conventionally used for example for the preparation of oil-in-water emulsions, particularly oxyalkylation products of higher fatty alcohols, higher fatty acids, higher fatty acids amides and alkyl substituted phenols. The higher alcohols, acids and amides preferably contain from 8–22, more preferably 12–18 carbon atoms per molecule, and the alkyl-substituted phenols are preferably substituted with one or two $C_{4-18}$, preferably $C_{4-9}$, alkyl groups. The alkylene oxide chains are preferably composed of ethylene oxide and/or propylene oxide units, and more preferably contain at least 50 mole % ethylene oxide units. The most preferred non-ionic surfactants of this type are those having 2–20, more preferably 4–15 ethylene oxide units, and no propylene oxide units, per molecule. Further types of suitable non-ionic surfactants are the sorbitol or glycerol esters of aliphatic carboxylic acids, or the Tetronics, which on account of their long alkylene oxide chains may be regarded as non-ionic in nature. The preferred types of non-ionic surfactants are those obtained by oxyalkylation of alcohols or acids. The quantity of non-ionic surfactant used is preferably no more than 30% of the weight of the cationic surfactant present.

The dispersions according to the present invention may, as stated above, contain non-oxidized paraffins, preferably crystalline paraffin wax, in addition to the oxidized microcrystalline wax. When such non-oxidized paraffins are present, their weight is preferably not more than 250% of the weight of oxidized microcrystalline wax. More preferably, their weight is not more than 150%, particularly not more than 100%, for example 10–100% of the weight of the oxidized microcrystalline wax. The surfactant (i.e. cationic surfactant plus optionally non-ionic surfactant) is used in sufficient quantity to ensure complete dispersion of the wax (by which is meant the oxidized microcrystalline wax plus any non-oxidized paraffins) in the aqueous phase, in order to obtain a stable dispersion at a suitably high concentration. Preferably the total weight of surfactant is 10 to 50%, more preferably 20–40% of that of the total weight of oxidized microcrystalline wax plus non-oxidized paraffins. The aqueous dispersion preferably contains up to 50% wt., for example 10–50% wt. of wax plus surfactant.

The aqueous dispersions may be prepared in conventional manner, preferably by melting the wax and surfactant together and pouring the melt into hot water at the same temperature as the melt with simultaneous or subsequent stirring or shaking, until the desired degree of dispersion is obtained, then cooling the mixture. If waxes melting above 105° C. are used, it is possible to carry out the process in a closed vessel under pressure. Preferably, however, the process is carried out at atmospheric pressure and a wax is used which melts at up to 105° C., more preferably up to 98° C. The preparation, appearance and stability of dispersions and emulsions are discussed for example in "Surfactants and Interfacial Phenomena" by M. J. Rosen, Wiley & Sons, 1978, particularly in Chapter 8. The average particle size of the dispersed particles in the aqueous dispersions according to the invention is preferably up to 10 μm, more preferably 0.01 to 2 μm, particularly 0.05 to 1 μm.

The melt of wax plus surfactant may also contain an acid, for example acetic acid, in order to convert the cationic surfactant from free base into protonated form. The dispersion may optionally contain conventional additives for example anti-foaming agents, wetting agents, protective colloids and fungicides.

The aqueous dispersions of the invention are useful as textile treatment agents to improve the workability of the textile substrate in mechanical processes, especially dry mechanical processes, and in particular sewing. When textile materials are sewn with high speed sewing machines (e.g. those making 2000–6000 stitches/min.) a certain degree of damage to the substrate by the needle, particularly fibre breakage, is observed, the extent of damage depending on factors such as the nature of the substrate, the type of needle used and the speed of the machine. The sewability of the substrate may be determined empirically for example by counting the number of thread breakages produced by sewing under standard conditions, but a better measure is the penetration force required to drive a standard sewing needle into the substrate. A higher measured penetration force indicates a greater resistance of the substrate to sewing, and a greater friction between substrate and needle. This high friction can lead to excessive heating of the needle and to fibre and thread breakages. Treatment of textile substrates with the dispersions of the present invention significantly reduces the penetration force, and thereby reduces the damage to the substrate on sewing.

Accordingly, the present invention also provides a process for the treatment of a textile substrate comprising applying to the substrate an aqueous dispersion of an oxidized microcrystalline wax containing a cationic surfactant as dispersing agent.

Suitable substrates for treatment by the process of the invention include those containing natural, synthetic or semisynthetic fibres, or mixtures thereof, particularly those containing natural or regenerated cellulose, natural or synthetic polyamide, polyester, polyurethane or polyacrylonitrile fibres, or mixtures thereof. The material can be in any conventional form, for example as fibres, filaments, threads, yarns, woven or knitted goods, fleeces, felts, carpets, velvets, tufted goods, semi-finished goods or artificial leather. Preferably the substrate is in the form of woven or knitted goods, particularly the latter.

The treatment process is advantageously carried out from an acidic aqueous medium, preferably at a pH between 3.5 and 6, more preferably between 4 and 5.5. The pH may be adjusted by addition of acids such as are conventionally used in textile processing, e.g. formic, acetic, citric or tartaric acids. The temperature of application is such as is compatible with the substrate and chemicals used, preferably between room temperature (18° C.) and 60° C., more preferably between 40° and 50° C.

The wax dispersion according to the invention has good substantivity and is suitable for application both by impregnation and by exhaust methods. The process of the invention thus includes application by conventional impregnation methods such as dipping, padding, foam or spray processes, continuous processes being preferred; and also by conventional exhaust processes using long or short liquor ratios, e.g. liquor-to-goods ratios of from 100:1 to 0.5:1, particularly from 60:1 to 2:1. Among the short liquor processes may be mentioned those carried out in winch becks and in dye-jet machines. The acid-shock process may also be used.

Although the treated goods may be rinsed once before drying, it is preferred to dry directly without rinsing.

Drying may be carried out at room temperature, but preferably by warming. Advantageously, drying is carried out at a temperature above the softening point, preferably above the melting point of the wax, particularly at 80°-150° C. The total wax concentration on the substrate can be varied within wide limits according to the nature of the substrate and the desired effect. Preferably however, it lies between 0.02% and 1.5%, more preferably 0.1% to 0.8, based on the dry weight of the substrate.

The treatment according to the invention is preferably carried out as the last finishing step before the mechanical working up of the substrate. It is convenient to carry out the treatment in the same apparatus as that used for an earlier finishing process, e.g. dyeing or optical brightening, crease-resistant finishing or softening. Thus a textile material may for example be dyed by the exhaust process and the dispersion according to the present invention be added to the last rinse water, or a fabric may be finished by a padding operation, in which the last step is padding with the dispersion of the invention.

Optionally another finishing process carried out from an aqueous medium, for example a softening and/or anti-static finishing step, may be carried out simultaneously with the process of the invention, particularly if the bath compositions for the other finishing process also contain cationic surfactants. The dispersion of the invention may be applied simultaneously with a resin finishing step employing conventional resins and catalysts.

The process of the invention significantly reduces machine damage, particularly damage by sewing, to the treated textile substrate, so that both fine and thick textile goods, as well as goods with a high content of synthetic fibers, can be sewn on high-speed industrial machines. The speed of operation of the sewing machine can thus be increased without causing excessive heating of the needle.

The wax finish on the substrate which is produced by the process of the invention has a softening effect and improves the handle of the goods. It may therefore be left on the finished goods, or, if desired, may be removed after the mechanical operations have been completed. The finish may be removed by washing with a suitable detergent solution, for example at 70°-90° C., preferably under mildly alkaline conditions.

The following Examples, in which all parts are by weight, illustrate the invention:

EXAMPLES

I Starting materials (all commercially available)

Oxidized microcrystalline waxes (products of Bareco Ltd. Oklahoma, USA)

| Reference | M.p. °C. | Acid No. | Hydrolysis No. | Hardness (ASTM-D-1321 |
|---|---|---|---|---|
| (a) | 96 | 12.5 | 35 | 3 |
| (b) | 82 | 26 | 55 | 8 |
| (c) | 98 | 13 | 30 | 2 |

Non-oxidized wax (d) paraffin wax, m.p. 56°-58° C.

Cationic surfactants

Surfactants of the following formulae were used:

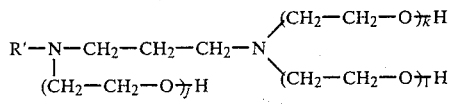

A

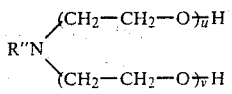

B

-continued

C

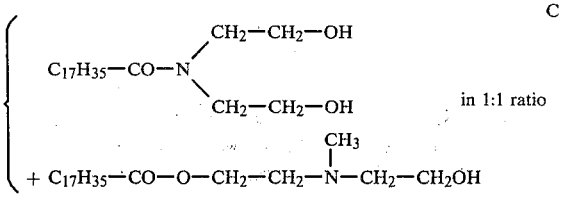

D

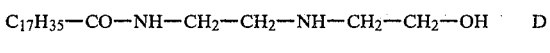

E

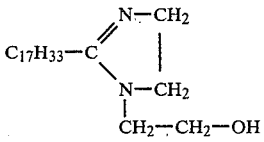

In which R′ is a mixture of alkyl and alkylene groups of the following formulae $C_{12}H_{25}$, 0.1%; $C_{14}H_{29}$, 0.9%; $C_{16}H_{33}$, 28.0%; $C_{18}H_{37}$, 28.0%; $C_{18}H_{35}$, 43.0%;

and R″ is a mixture of $C_{12}H_{25}$, 3.0%; $C_{14}H_{29}$, 3.0%; $C_{16}H_{33}$, 6.0%; $C_{16}H_{31}$, 4.0%; $C_{18}H_{37}$, 9.0%; and $C_{18}H_{35}$, 75.0%.

In (A) above, 5 different products may be distinguished by the total number of oxyethylene groups (j+k+l) present: ($A_1$), 0; ($A_2$), 7; ($A_3$), 12; ($A_4$), 21 and ($A_5$), 33.

In (B) above u+v=15.

Product A is of type (c) above, product (B) is of type (a), product (C) is of type (g) (methylated product of VII+VIII), product D is of type (g) (IX) and product E is of type (h).

II Preparation of wax dispersions

150 Parts wax, 45 parts surfactant and w parts glacial acetic acid (see table of examples) were melted together with stirring and poured into 500 parts boiling water, with stirring. The fine emulsion so prepared was allowed to cool, and resulting thin milky dispersion discharged.

III Application methods

Exhaust process

The substrate is treated at 40° C. and a liquor-to-goods ratio of 40:1 in an aqueous bath containing 0, 2.4% or 3% (based on dry wt. of substrate) of the wax dispersion. After 20 minutes agitation at 40° C. the substrate is removed from the bath and dried without tension for 90 seconds at 140° C. Alternatively the wax dispersion may be added to the bath when the substrate is already present. In the table of examples, the exhaust application process at the various concentrations is designated as follows:

$Ex_0$=0% (blank run)

$Ex_{2.4}$=2.4%

$Ex_3$=3%

Padding process

The substrate is padded at room temperature to a pick-up of 75% based on its dry weight, with an aqueous bath containing varying concentrations of the above aqueous dispersion, then dried for 90 seconds at 140° C.

In the table of the examples, the padding process and concentrations used are designated as follows:

$P_0$=0 g/l $P_{20}$=20 g/l $P_{30}$=30 g/l $P_{40}$=40 g/l $P_{50}$=50 g/l

IV Substrates

In the table of examples, the substrates used are designated as follows:

$S_1$ cotton tricot (interlock)

$S_2$ cotton tricot with resin finishing $S_3$ cotton/polyester woven fabric with resin finish $S_4$ wool woven fabric $S_5$ polyester (Crimplene® double jersey) fixed at 200° C., 30 seconds $S_6$ nylon 66 (Nyltest®, chain knit) fixed at 200° C., 30 seconds $S_7$ Polyacrylonitrile (Orlon®, single jersey)

V Sewability test method

Two pieces of the same textile substrate are treated under the same conditions and dried separately without tension. After 24 hours equilibration at 65% R.H. 20° C., both treated pieces are sewn, together but without sewing thread, with a Pfaff type 483 step stitch sewing machine at a speed of 4700 stitches/min. The penetration force is measured by a strain gauge bridge located under the fabric at the point of sewing, and is registered on a UV chart recorder. The penetration force is read off the recorder when, after an initial period, the sewing speed (4700 stitches/min.) becomes approximately constant. The zero value is read off the recorder when the machine is operating at the same speed but without fabric. An average value of the penetration force is taken for 10 seams each of 100 stitches.

The needles used are of the types SUK (medium ball point) and SES (small ball point) supplied by Messrs. F. Schmetz GmbH, 5120 Herzogenrath, Germany, and are described in their publication "Taschenbuch der Nähtechnik", 1975.

VI Table of Examples and Comparative Examples

In the following table, the wax, surfactant, amount of acetic acid, application process, substrate, text needle and penetration force are given as described above. Examples marked with a dash, e.g. 1′, are comparative Examples in which no wax dispersion was added, but the same substrate was tested with the same needle.

| Example No. | Wax | Surfactant | w | Applic. Process | Substrate | needle | Penetration force g/stitch |
|---|---|---|---|---|---|---|---|
| 1 | a | $A_1$ | 15 | $P_{40}$ | $S_1$ | SUK 90 | 640 |
| 1′ | — | — | — | $P_0$ | $S_1$ | SUK 90 | 1020 |
| 2 | b | $A_1$ | 15 | $P_{20}$ | $S_1$ | SUK 70 | 90 |
| 2′ | — | — | — | $P_0$ | $S_1$ | SUK 70 | 550 |
| 3 | c | $A_1$ | 1.5 | $Ex_3$ | $S_1$ | SUK 70 | 115 |
| 3a | c | $A_2$ | 0.75 | " | " | " | 90 |
| 3b | c | $A_3$ | 0.4 | " | " | " | 86 |
| 3c | c | $A_4$ | 0 | " | " | " | 80 |
| 3d | c | $A_5$ | 0 | " | " | " | 100 |
| 3e | c | B | 0.1 | " | " | " | 105 |
| 3f | c | $A_1$ + D (1:1) | 4.5 | " | " | " | 160 |
| 3g | c | $A_4$ + C (1:2) | 0.5 | " | " | " | 78 |
| 3h | c | E | 5 | " | " | " | 150 |
| 3′ | — | — | — | $Ex_0$ | " | " | 620 |
| 4 | a | $A_4$ + C (1:2) | 0.5 | $Ex_3$ | $S_1$ | SUK 70 | 60 |

-continued

| Example No. | Wax | Surfactant | w | Applic. Process | Substrate | needle | Penetration force g/stitch |
|---|---|---|---|---|---|---|---|
| 4a | a + d (50:50) | $A_4$ + C (1:2) | 0.5 | $Ex_3$ | $S_1$ | SUK 70 | 60 |
| 4b | a + d (40:60) | $A_4$ + C (1:2) | 0.5 | $Ex_3$ | $S_1$ | SUK 70 | 75 |
| 4c | a + d (30:70) | $A_4$ + C (1:2) | 0.5 | $Ex_3$ | $S_1$ | SUK 70 | 85 |
| 4' | — | — | — | $Ex_0$ | $S_1$ | SUK 70 | 680 |
| 5 | c | $A_4$ + C (1:2) | 0.5 | $P_{30}$ | $S_1$ | SUK 70 | 85 |
| 5' | — | — | — | $P_0$ | $S_1$ | SUK 70 | 670 |
| 6 | c | $A_4$ + C (1:2) | 0.5 | $P_{30}$ | $S_2$ | SES 70 | 130 |
| 6' | — | — | — | $P_0$ | $S_2$ | SES 70 | 310 |
| 7 | c | $A_4$ + C (1:2) | 0.5 | $P_{30}$ | $S_3$ | SES 90 | 220 |
| 7' | — | — | — | $P_0$ | $S_3$ | SES 90 | 360 |
| 8 | c | $A_4$ + C (1:2) | 0.5 | $P_{50}$ | $S_4$ | SES 80 | 33 |
| 8' | — | — | — | $P_0$ | $S_4$ | SES 80 | 90 |
| 9 | c | $A_4$ + C (1:2) | 0.5 | $P_{50}$ | $S_5$ | SES 80 | 50 |
| 9' | — | — | — | $P_0$ | $S_5$ | SES 80 | 180 |
| 10 | c | $A_4$ + C (1:2) | 0.5 | $P_{50}$ | $S_6$ | SES 80 | 50 |
| 10' | — | — | — | $P_0$ | $S_6$ | SES 80 | 180 |
| 11 | c | $A_4$ + C (1:2) | 0.5 | $P_{50}$ | $S_7$ | SES 80 | 22 |
| 11' | — | — | — | $P_0$ | $S_7$ | SES 80 | 80 |
| 12 | c + d (50:50) | B + C (0.65:1) | 1.6 | $Ex_{2.4}$ | $S_1$ | SUK 70 | 90 |
| 12' | — | — | — | $Ex_0$ | $S_1$ | SUK 70 | 730 |
| 13 | c + d (50:50) | B + C (0.65:1) | 1.6 | $P_{30}$ | $S_1$ | SUK 70 | 90 |
| 13' | — | — | — | $P_0$ | $S_1$ | SUK 70 | 710 |

If, in the preparation of the wax dispersions, 28 parts of an isoparaffin, liquid at room temperature, boiling in the range of 210°–250° C. and with flash point 78° C. are added, comparable good results are obtained. The particle size of the dispersions used in Examples 1–13 (with or without addition of isoparaffin) lies in the range of 0.1 to 1 μm.

What is claimed is:

1. An aqueous dispersion suitable for imparting lubricity to textile substrates comprising an oxidized, microcrystalline wax and, as a dispersing agent, at least one cationic surfactant.

2. A dispersion according to claim 1, in which the oxidized microcrystalline wax has an acid number of 5 to 65, an esterification number of 15 to 90, a melting point of at least 80° C., a penetration value according to ASTM-D-1321 of 1 to 16, and a molecular weight between 300 and 3000.

3. A dispersion according to claim 1, in which one or more non-oxidized paraffins are present in addition to the oxidized microcrystalline wax.

4. A dispersion according to claim 1, in which the cationic surfactant is one whose molecule contains at least one lipophilic aliphatic residue having at least 7 carbon atoms, and at least one cationic nitrogen atom, the lipophilic aliphatic residue being in the cationic part of the molecule.

5. A dispersion according to claim 4 in which the cationic surfactant comprises one or more compounds of types (a)–(j) below:

(a) fatty amines of formula I

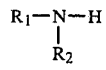

I in which $R_1$ is $C_{8-22}$alkyl or $C_{8-22}$alkenyl and $R_2$ is hydrogen, $C_{1-22}$alkyl or $C_{3-22}$alkenyl,
together with their ethylene oxide and/or propylene oxide addition products (b) fatty amines of formula II

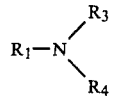

II in which
$R_1$ is as defined above and
$R_3$ and $R_4$ are independently $C_{1-22}$alkyl or $C_{3-22}$alkenyl (c) polyamines of formula III

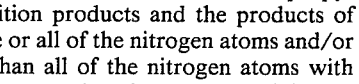

III in which
$R_1$ is as defined above,
A is $—CH_2—CH_2—$ or $—CH_2—CH_2—CH_2—$ and
m is an integer from 1 to 4, whereby when m > 1, the groups A may be the same or different,
together with their ethylene oxide and/or propylene oxide addition products and the products of alkylating some or all of the nitrogen atoms and/or acylating less than all of the nitrogen atoms with saturated or unsaturated acyl groups containing up to 22 carbon atoms (d) acylation products of polyamines of formula IV

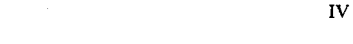

IV where A is as defined above and n is an integer from 1 to 5, whereby when n > 1 the groups A may be the same or different,
with up to n saturated or unsaturated acyl groups containing up to 22 carbon atoms, at least one of which is of formula $R_5$—CO— where $R_5$ is $C_{7-21}$alkyl or $C_{7-21}$alkenyl; together with their alkylation, oxyethylation and/or oxypropylation products (e) compounds of formula V

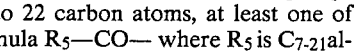

V in which $R_5$ is as defined above
together with their alkylation, oxyethylation and/or oxypropylation products (f) O-acylation products of ethanolamines of formula VI

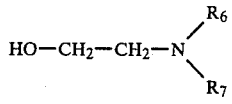

VI in which $R_6$ and $R_7$ are independently $C_{1-4}$alkyl or $—CH_2CH_2OH$,
with up to 3 saturated or unsaturated acyl groups containing up to 22 carbon atoms, at least one of which is of formula $R_5$—CO—, where $R_5$ is as defined above, whereby, when the acylation product contains one of two —OH groups, these may be alkylated, oxyethylated and/or oxypropylated (g) monoacylation products of diethanolamine and mono- to di-acylation products of N-aminoethyl-N-ethanolamine with the acyl group $R_5$—CO—, where $R_5$ is defined above together with their alkylation, oxyethylation and/or oxypropylation products (h) Imidazolines of formula XII

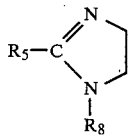

XII in which $R_5$ is as previously defined and $R_8$ is $—CH_2CH_2OH$, $—CH_2CH_2NH_2$ or $—CH_2CH_2CH_2NH_2$, together with their acylation (with saturated or unsaturated acyl groups containing up to 22 carbon atoms), alkylation, oxyethylation and/or oxypropylation products (i) reaction products of compounds of formula XIII $$R_1\text{-}(O—A')_pOCH_2—CHOH—CH_2Cl \qquad \text{XIII}$$

in which $R_1$ is as defined above,

A' is $—CH_2CH_2—$ or $—CH_2CH(CH_3)—$ and p is from 0 to 20, with amines of formulae I, III or IV above or XIV

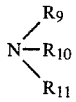

XIV in which $R_9$, $R_{10}$ and $R_{11}$ are independently hydrogen or $—CH_2CH_2OH$ (j) compounds of formula XV

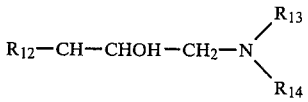

XV in which $R_{12}$ is a group of formula $R_5COO—$, $R_5CONHCH_2CH_2O—$, $R_1O—$ or $R_1NH—$ in which $R_1$ and $R_5$ are as defined above, $R_{13}$ is hydrogen, methyl or ethyl, and $R_{14}$ is $C_{8-22}$alkyl or alkenyl, or a group of formula $—CH_2CH_2CH_2NHR_1$ or $—CH_2CH_2OH$.

6. A dispersion according to claim 1, in which a non-ionic surfactant is present in addition to the cationic surfactant.

7. A process for the preparation of an aqueous dispersion of an oxidized microcrystalline wax according to claim 1 in which the wax is melted together with one or more cationic surfactants and, optionally, one or more non-oxidized paraffins and, optionally, one or more non-ionic surfactants, and the melt is dispersed in water at a temperature above the melting point of the wax, which is then cooled.

8. A process for the treatment of a textile substrate comprising applying to the substrate an aqueous dispersion of an oxidized microcrystalline wax according to claim 1.

9. A process according to claim 8 in which the treated goods are dried at a temperature above the melting point of the applied wax.

10. Textile substrates whenever treated by the process of claim 8.

* * * * *

UNITED STATES PATENT AND TRADEMARK OFFICE

CERTIFICATE OF CORRECTION

PATENT NO. : 4,329,390

DATED : May 11, 1982

INVENTOR(S) : BERNARD DANNER

It is certified that error appears in the above-identified patent and that said Letters Patent is hereby corrected as shown below:

Column 3, line 23; before "or", change "$C_{7-22}$alkyl" to --$C_{7-21}$alkyl--.

Column 13, line 1; after "one", change "of" to --or--.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*